US005179844A

United States Patent [19]

Lyman et al.

[11] Patent Number: 5,179,844

[45] Date of Patent: Jan. 19, 1993

[54] LIQUID ACCUMULATOR

[75] Inventors: Tommy L. Lyman, Piqua; Kenneth B. Newman, Kettering, both of Ohio

[73] Assignee: General Motors Corporation, Detroit, Mich.

[21] Appl. No.: 730,760

[22] Filed: Jul. 16, 1991

[51] Int. Cl.[5] ..... F25B 43/00

[52] U.S. Cl. ..... 62/503; 55/192

[58] Field of Search ..... 62/503, 84, 468, 512; 55/192, 410, 413

[56] References Cited

U.S. PATENT DOCUMENTS

| | | | |
|---|---|---|---|
| 4,111,005 | 9/1978 | Livesay | 62/503 |
| 4,182,136 | 1/1980 | Morse | 62/503 |
| 4,199,960 | 4/1980 | Adams et al. | 62/503 |
| 4,270,934 | 6/1981 | Widdowson et al. | 62/503 X |
| 4,291,548 | 9/1981 | Livesay | 62/503 |
| 4,331,001 | 5/1982 | Jones | 62/503 |
| 4,474,035 | 10/1984 | Amin et al. | 62/503 |
| 4,496,378 | 1/1985 | Kish | 55/316 |
| 4,583,377 | 4/1986 | Viegas | 62/503 |
| 4,651,540 | 3/1987 | Morse | 55/192 X |
| 4,675,971 | 6/1987 | Masserang | 62/503 X |
| 4,827,725 | 5/1989 | Morse | 62/503 |
| 4,866,951 | 9/1989 | Masterson, II | 62/503 |
| 4,938,036 | 7/1990 | Hodgkins et al. | 62/503 |
| 4,938,037 | 7/1990 | Carlisle, Jr. | 62/503 |
| 5,048,309 | 9/1991 | Carlisle, Jr. et al. | 62/503 |
| 5,052,193 | 10/1991 | Pettitt et al. | 62/503 |

FOREIGN PATENT DOCUMENTS

| | | | |
|---|---|---|---|
| 3545013 | 12/1986 | Fed. Rep. of Germany | 62/503 |
| 0041847 | 4/1978 | Japan | 62/503 |
| 859774 | 9/1981 | U.S.S.R. | 62/503 |
| 1291795 | 2/1987 | U.S.S.R. | 62/503 |

*Primary Examiner*—Henry A. Bennet
*Assistant Examiner*—Christopher B. Kilner
*Attorney, Agent, or Firm*—Ronald L. Phillips

[57] ABSTRACT

A liquid accumulator for a motor vehicle air conditioning system having a liquid separator and return pipe having an inlet end formed with a flared or trumpet shape that forms a baffle to prevent liquid entry into the return pipe.

2 Claims, 1 Drawing Sheet

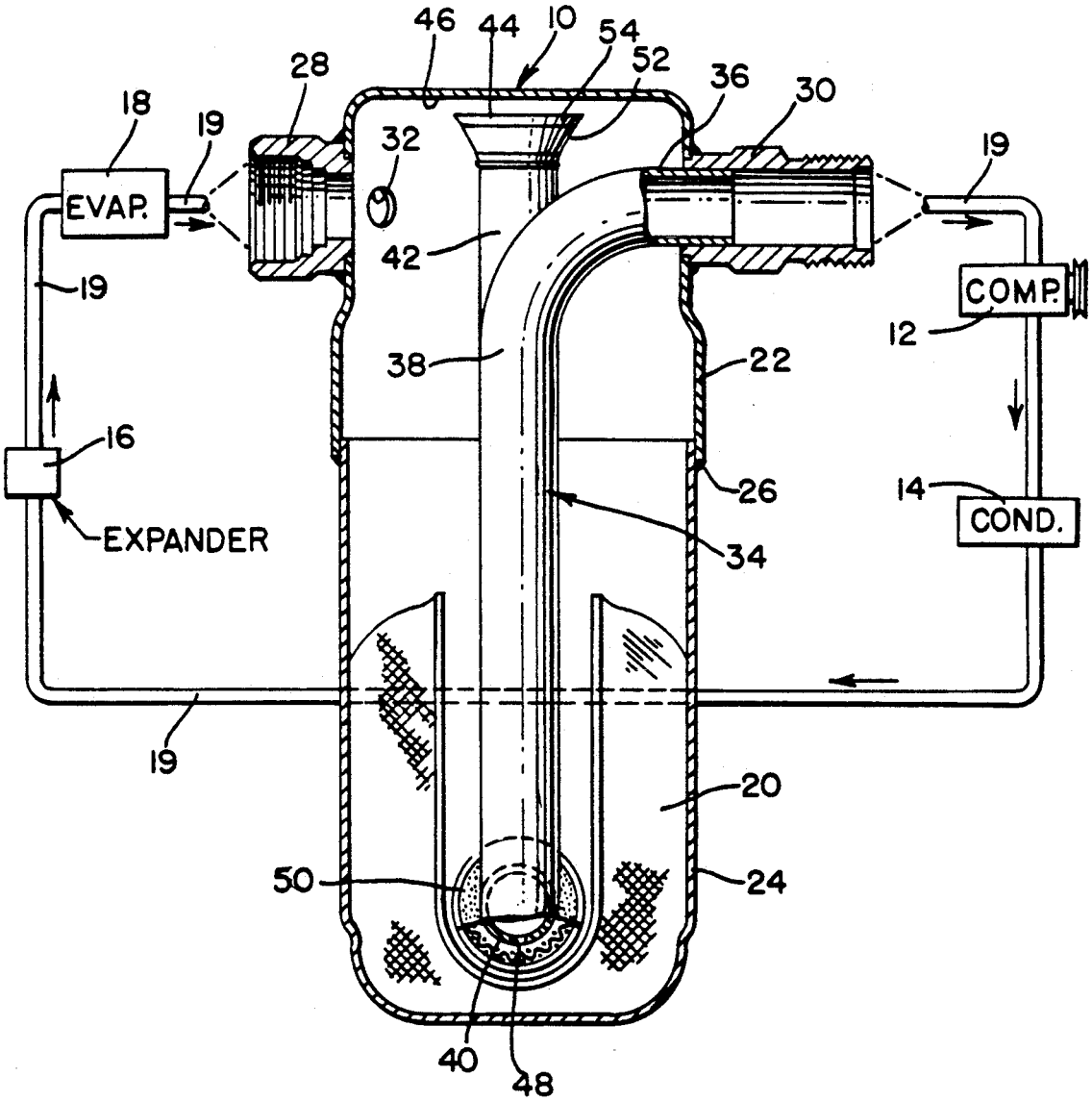
46
44
10
54
52
28
36
30
18
19
32
19
EVAP.
42
19
COMP.
12
38
22
16
26
14
EXPANDER
34
COND.
19
20
50
24
40
48

LIQUID ACCUMULATOR

TECHNICAL FIELD

This invention relates to liquid accumulators for use in air conditioning and refrigeration systems and the like and, more particularly, to the separation pipe used in such accumulators.

BACKGROUND OF THE INVENTION

In air conditioning systems such as those for motor vehicle use, a liquid accumulator is normally connected between the evaporator and suction side of the compressor to prevent liquid refrigerant from entering the latter while permitting gaseous refrigerant to pass. This separation of liquid, as well as its eventual return in gaseous form, is accomplished by either a straight or U-shaped pipe whose inlet end is positioned high in the accumulator so as to be open to receive the vaporous refrigerant flow delivered from the evaporator. A baffle mounted either on the ceiling of the accumulator or directly on the open end of the pipe, as disclosed in U.S. Pat. No. 4,111,005, operates to separate liquid including refrigerant, oil and water from the vaporous refrigerant flow delivered to the accumulator and deposit same on the bottom of the accumulator casing. A desiccant is normally stored in the bottom of the casing to adsorb the water while the deposited liquid refrigerant and oil is eventually aspirated to the compressor through a bleed opening provided in the bottom of the pipe. While such accumulators have proven quite successful, they are typically a multi-part assembly and there remains a desire to both simplify the structure as well as reduce cost without sacrificing efficiency.

SUMMARY OF THE INVENTION

The present invention is directed to providing an improved liquid accumulator wherein the baffle as a separate part is eliminated and at the same time efficiency is improved by way of reduced pressure drop through the accumulator. This is accomplished by simply forming the inlet end of the pipe with a trumpet shape located closely adjacent the top of the accumulator and above the inlet to the accumulator from the evaporator. It has been found that by providing the trumpet-shaped inlet with a certain taper or included angle and maintaining a uniform diameter through the length of the pipe and by placing the opening above the inlet there is allowed an increased liquid volume in the accumulator before flooding to the compressor occurs while pressure drop is reduced at the pipe entrance as well as along the length thereof and thus across the accumulator. This can ultimately result in a reduced internal accumulator internal volume with the same performance as that prior to the above improvements.

It is therefore an object of the present invention to provide a new and improved liquid accumulator.

Another object is to provide in a liquid accumulator a liquid separating and return pipe having a flared or trumpet-shaped inlet end located near the top of the accumulator and above the inlet to the accumulator from the evaporator.

Another object is to provide a new and improved simple, low cost, easy to manufacture liquid accumulator.

These and other objects and advantages of the present invention will become more apparent from the following description and drawing in which:

BRIEF DESCRIPTION OF THE DRAWING

The sole figure in the drawings is a sectional side view of a liquid accumulator according to the present invention and also a schematic view of a motor vehicle air conditioning system in which the accumulator is shown in use.

DESCRIPTION OF THE PREFERRED EMBODIMENT

Referring to the drawing, there is shown a liquid accumulator 10 for a motor vehicle air conditioning system whose other components generally comprise a compressor 12 that is belt-driven from the motor vehicle's engine (not shown), a condenser 14, an expander (orifice tube) 16, and an evaporator 18 which are all of conventional type and connected by lines 19 in conventional manner as well known in the art. As is also well known, the function of the liquid accumulator 10 is to separate liquid including water, oil and refrigerant from the vaporous refrigerant received from the evaporator 18 and deposit same in the bottom of the accumulator where the water is then absorbed by a desiccant 20 while the liquid refrigerant and oil is eventually aspirated to the compressor through a bleed opening in the bottom of the pipe along with the vaporous refrigerant flow passing directly through the accumulator.

The liquid accumulator 10 is of the type having a permanently assembled cylindrical casing or canister comprised of upper and lower cylindrical portions 22, 24 which are each normally closed at one end and open at the other end and are adapted to be telescopically received together and joined at their open ends by an annular weld 26. The upper casing portion 22, whose upper end serves as the top of the accumulator, has both an inlet fitting 28 and an outlet fitting 30 by which the accumulator is connected to the line from the evaporator 18 and the line to the compressor 12 respectively. Both these fittings are located near the top of the accumulator and are welded to the upper casing at locations generally opposite each other. In addition, a charge fitting is also welded to the upper casing portion (only the through hole 32 in the side wall being shown) and it is through this opening that the system is charged with refrigerant.

Interior of the canister, there is provided a U-shaped pipe 34 having an outlet end 36 that is press fitted into the outlet fitting 30, a downward leg 38 that extends downward from the outlet fitting to a point adjacent to the bottom, a bite portion or return bend 40 that makes a turn near the bottom of the canister, and an upward leg 42 that extends upwards and terminates at an inlet end 44 adjacent the top or ceiling 46 of the canister. The bite portion 40 of the pipe has a bleed port 48 through the bottom side thereof that is located adjacent to and faces the closed bottom end of the casing and is covered by a cylindrical screen assembly 50 that is received about the bite portion 40 and serves to screen out particles in the collected liquid at the bottom to prevent clogging of the bleed port and their return to the circulatory system. The U-shape of the pipe as well as the details of the bleed hole and screen assembly are like that shown in U.S. Pat. No. 4,291,548 assigned to the assignee of this invention and which is hereby incorporated by reference.

According to the present invention, the inlet end 44 of the pipe 34 is formed with a trumpet or flared shape portion 52 that is located above the inlet fitting 28 with its rim 54 strategically close to the ceiling 46 of the canister. The rim of the inlet end 52 is located close enough to the top so as to inhibit entry of the liquid refrigerant impinging on the interior side wall of the canister while not being so close as to effect any measurable pressure drop across the actual entry opening to the pipe. It has been found that the taper of the trumpet-shaped section 52 should be not less than about 20 degrees i.e., an included angle of 40 degrees, so as to further inhibit rebounding liquid droplets off the interior side and top of the canister from entering the inlet end while further serving to prevent pressure drop at this end of the pipe. Different methods may be used to form the trumpet shape such as spinning or cold heading to make as large a trumpet diameter as possible without tearing the material. Alternatively, it is also envisioned that the tube could be made of molded plastic in which case the material would not then limit the included angle of the trumpet Moreover, the pipe 34 is formed with a uniform or constant diameter throughout its length including that at its outlet end and except, of course, for the tapered inlet end. This together with the tapered inlet have been found to produce the least pressure drop across the accumulator.

The foregoing description of the preferred embodiment of the invention has been presented for purposes of illustration and description. It is not intended to be exhaustive or to limit the invention to the precise form disclosed as obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. In an air conditioning system liquid refrigerant accumulator of the type comprising a canister having a top, bottom and side wall with a generally U-shaped pipe inside said canister through which refrigerant in gaseous form is drawn, said pipe having an outlet end opening through said side wall and an inlet end, the improvement comprising, said inlet end having a flared, trumpet shape opening in a direction toward said canister top, said inlet end also having a rim located sufficiently close to said top so as to restrict the entry of liquid refrigerant thereto but sufficiently far therefrom so as to allow free flow of gaseous refrigerant thereto.

2. In an air conditioning system liquid refrigerant accumulator of the type comprising a canister having a top, bottom and side wall with a generally U-shaped pipe inside said canister through which refrigerant in gaseous form is drawn, said pipe having an outlet end opening through said side wall and an inlet end, the improvement comprising, said inlet end having a flared, trumpet shape subtending an angle of at least about 40 degrees and opening in a direction toward said canister top, said inlet end also having a rim located sufficiently close to said top so as to restrict the entry of liquid refrigerant thereto but sufficiently far therefrom so as to allow free flow of gaseous refrigerant thereto with minimal pressure drop.

* * * * *